US011180931B2

(12) United States Patent
Chang

(10) Patent No.: US 11,180,931 B2
(45) Date of Patent: Nov. 23, 2021

(54) DOOR LOCK DEVICE

(71) Applicant: Gianni Industries Inc., Taipei (TW)

(72) Inventor: Chih Chung Chang, Taipei (TW)

(73) Assignee: GIANNI INDUSTRIES INC., Taipei (TW)

( * ) Notice: Subject to any disclaimer, the term of this patent is extended or adjusted under 35 U.S.C. 154(b) by 633 days.

(21) Appl. No.: 16/115,715

(22) Filed: Aug. 29, 2018

(65) Prior Publication Data

US 2020/0071959 A1 Mar. 5, 2020

(51) Int. Cl.
*E05B 47/06* (2006.01)
*E05B 47/02* (2006.01)
*E05B 47/00* (2006.01)

(52) U.S. Cl.
CPC ..... *E05B 47/0607* (2013.01); *E05B 47/023* (2013.01); *E05B 2047/0072* (2013.01)

(58) Field of Classification Search
CPC ..... E05B 47/0047; E05B 47/0004; E05B 47/0002; E05B 47/0046; E05B 47/0603; E05B 47/00; E05B 47/0607; E05B 47/023; E05B 2047/0072; Y10T 292/696; Y10T 70/7062
See application file for complete search history.

(56) References Cited

U.S. PATENT DOCUMENTS 8,047,585 B1 * 11/2011 Peabody ..... E05B 47/0046 292/341.16
8,833,814 B2 * 9/2014 Chang ..... E05B 47/0047 292/341.16
8,851,532 B2 * 10/2014 Geringer ..... E05B 47/00 292/200
10,781,611 B2 * 9/2020 Schildwachter .... E05B 17/2084
2007/0046040 A1 * 3/2007 Chang ..... E05B 47/0047 292/341.16
2007/0101781 A1 * 5/2007 Galla ..... E05B 47/0002 70/257
2008/0006069 A1 * 1/2008 Liao ..... E05B 63/0065 70/413
2010/0116006 A1 * 5/2010 Huang ..... E05B 47/0047 70/91
2010/0127518 A1 * 5/2010 Huang ..... E05B 47/0047 292/341.16
2011/0241361 A1 * 10/2011 Orbeta ..... E05B 15/0093 292/341.16
2015/0130195 A1 * 5/2015 Liao ..... E05B 47/0004 292/194

* cited by examiner

*Primary Examiner* — Mark A Williams
(74) *Attorney, Agent, or Firm* — Browdy and Neimark, PLLC

(57) ABSTRACT

A door lock device is worked in cooperate with a latch bolt, and includes a solenoid device engaged in a housing, a catch member pivotally attached to the housing with a spindle, two arms connected between the catch member and the spindle, and the solenoid device includes a shaft slidably engaged in a receptacle, and the shaft includes an upper end portion extendible upwardly beyond the receptacle and a lower end portion extendible downwardly beyond the receptacle, and the solenoid device includes two anchors on the upper end portion for selectively engaging with the upper arm, and two stops on the lower end portion for selectively engaging with the lower arm of the latch device, and for allowing the catch member to be evenly engaged with the latch bolt.

9 Claims, 8 Drawing Sheets

DOOR LOCK DEVICE

BACKGROUND OF THE INVENTION

1. Field of the Invention

The present invention relates to a door lock device, and more particularly to a door lock device including a safety structure or mechanism for allowing the door lock device to be suitably and safely operated or actuated and for allowing the working life of the door lock device to be suitably increased and improved.

2. Description of the Prior Art

Various kinds of typical lock devices, such as electric dropbolts, cathode locks or the like have been developed and provided for conducting or operating or locking and unlocking various door devices, and normally comprise a core or deadbolt actuatable or movable or operatable with a coil or an electromagnetic mechanism to actuate the deadbolt or tongue and to lock or unlock a door or window or the like.

For example, U.S. Patent Application Publication No. US 2010/0116006 A1 to Huang discloses one of the typical deadbolt lock devices each also comprising a deadbolt or tongue attached to a door panel for engaging with a strike lock device or the like that is attached to a door frame or the like, and for selectively locking a door panel to a door frame or the like, and a lock member disposed or engaged in the strike lock device for engaging with the deadbolt or tongue and for selectively latching and anchoring or retaining or positioning the tongue to the strike lock device and for preventing the tongue from being disengaged or separated from the strike lock device.

However, the lock member may not be solidly and stably and evenly engaged with the deadbolt or tongue and may not solidly and stably anchor or retain or position the deadbolt or tongue to the strike lock device and the deadbolt or tongue may have a good chance to be tilted or inclined relative to the strike lock device and may thus be damaged.

The present invention has arisen to mitigate and/or obviate the afore-described disadvantages of the conventional strike or door lock devices.

SUMMARY OF THE INVENTION

The primary objective of the present invention is to provide a door lock device including a safety structure or mechanism for allowing the door lock device to be suitably and safely operated or actuated and for allowing the working life of the door lock device to be suitably increased and improved.

In accordance with one aspect of the invention, there is provided a door lock device attached to a door member for working in cooperate with a latch bolt which is attached to a door element, the door lock device comprises a housing attached to the door member, the housing includes a chamber formed in the housing, a solenoid device is engaged in the chamber of the housing and attached to the housing, a latch device includes a catch member pivotally attached to the housing with a spindle for allowing the catch member to be pivoted and rotated relative to the housing, the latch device includes a first arm and a second arm connected between the catch member and the spindle, and the solenoid device includes a receptacle, and a shaft slidably engaged in the receptacle and moveable either upwardly or downwardly relative to the receptacle, and the shaft includes a first end portion extendible upwardly beyond the receptacle and a second end portion extendible downwardly beyond the receptacle, and the solenoid device includes a first anchor and a second anchor provided on the first end portion of the shaft for selectively engaging with the first arm of the latch device, and a first stop and a second stop provided on the second end portion of the shaft for selectively engaging with the second arm of the latch device, and either of the first anchor or the second anchor is engaged with the first arm of the latch device when the shaft is moved either upwardly or downwardly relative to the receptacle, and either of first stop or the second stop is engaged with the second arm of the latch device when the shaft is moved either upwardly or downwardly relative to the receptacle, for allowing the catch member to be evenly engaged with the latch bolt and for allowing the working life of the door lock device to be suitably increased and improved.

The latch device includes a spring biasing member engaged between the housing and the latch device for biasing and forcing the catch member to move into the chamber of the housing. The spring biasing member is preferably engaged onto the spindle. The first arm and the second arm are connected between the catch member and the spindle for forming a parallelepiped structure.

The housing includes a bracket engaged in the chamber of the housing and secured to the housing with fasteners or the like for engaging with and for supporting the solenoid device in the housing. The bracket includes two flaps extended from the bracket and engaged with the solenoid device for solidly engaging with and supporting the solenoid device in the housing and for preventing the solenoid device from being disengaged or separated from the housing.

The housing includes a partition attached to the front portion of the housing, the partition includes an opening formed therein and communicating with the chamber of the housing and aligned with the latch bolt for allowing the latch bolt to be engaged through the opening of the partition and to be engaged into the chamber of the housing and to be engaged with the catch member.

The housing includes a detecting device attached to the housing, and the detecting device includes a switch button, and a detecting element is pivotally attached to the housing with an axle, and the axle includes a projection extended from the axle and located close to the switch button of the detecting device for actuating and operating the switch button of the detecting device selectively when the detecting element is depressed or actuated by the latch bolt. The housing includes a block engaged in the chamber of the housing and secured to the housing with fasteners or the like, the detecting device is attached and secured to the housing with the block and fasteners or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
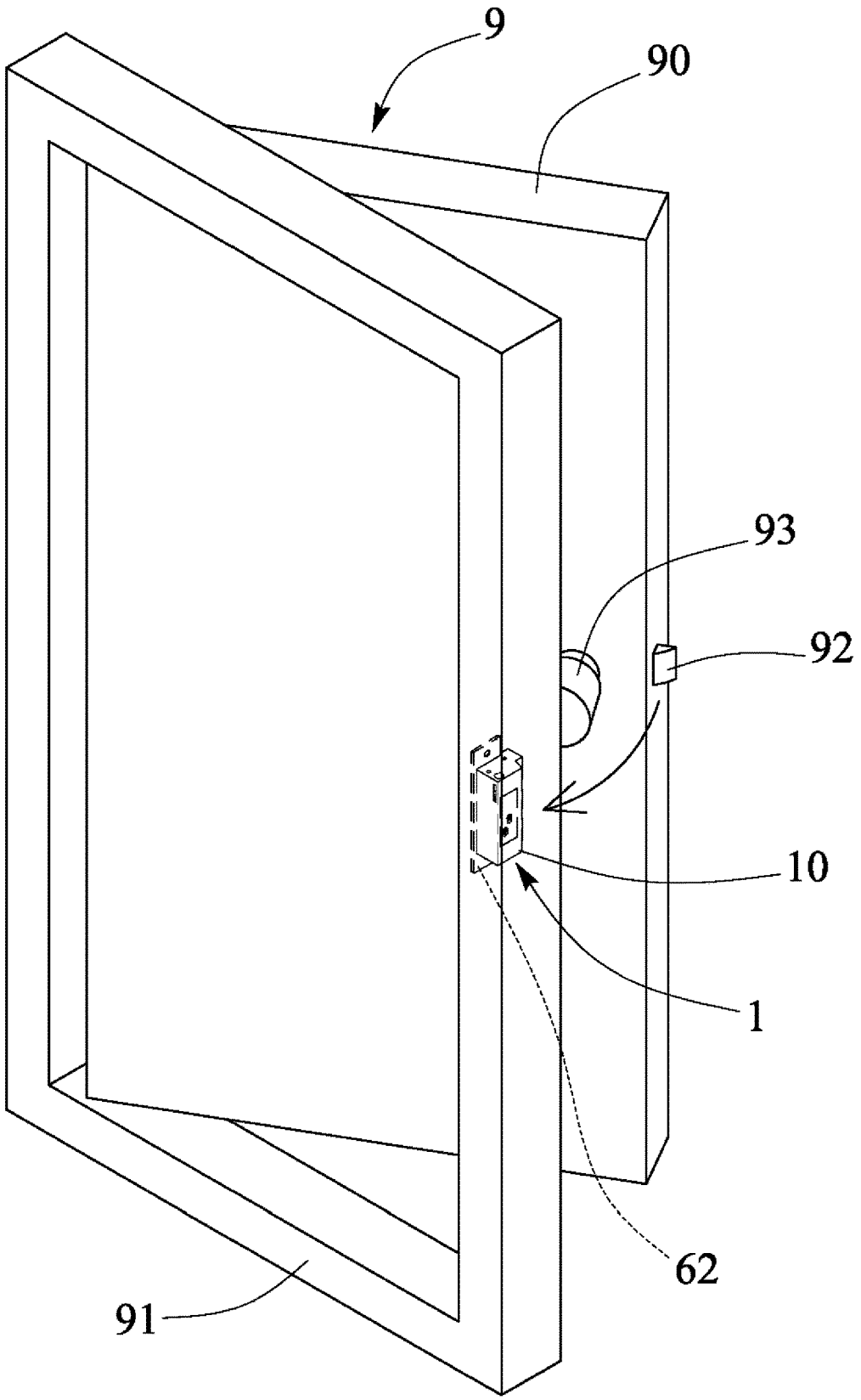
FIG. 1 is a partial perspective view of a door lock device in accordance with the present invention for a door device.
Figure 2:
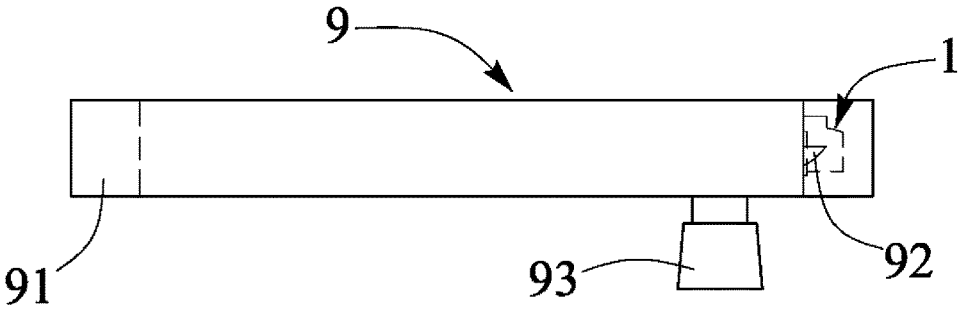
FIG. 2 is a top plan schematic view of the door device, as seen from the upper portion of the door device.
Figure 3:
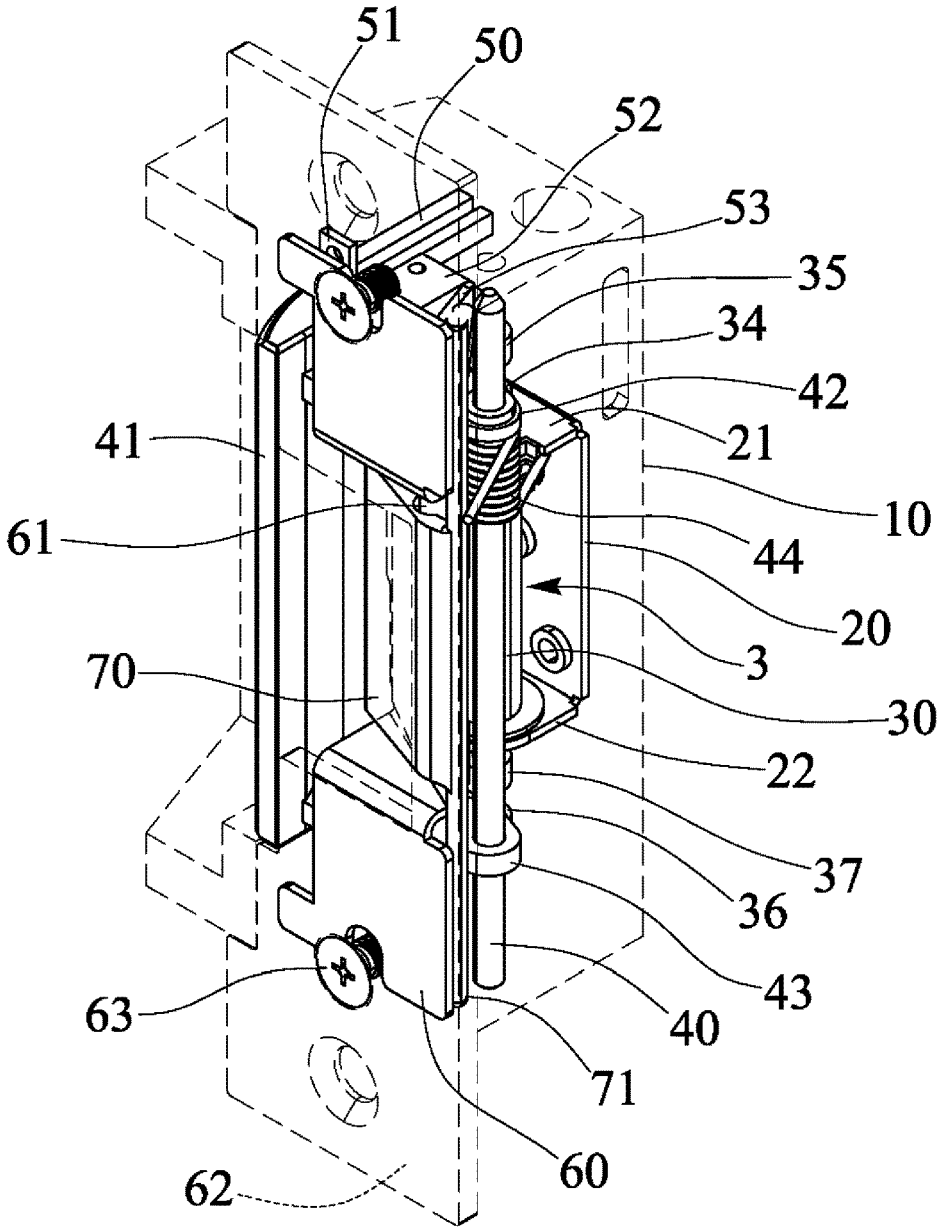
FIG. 3 is a partial perspective view of the door lock device as seen from the other direction.
Figure 4:
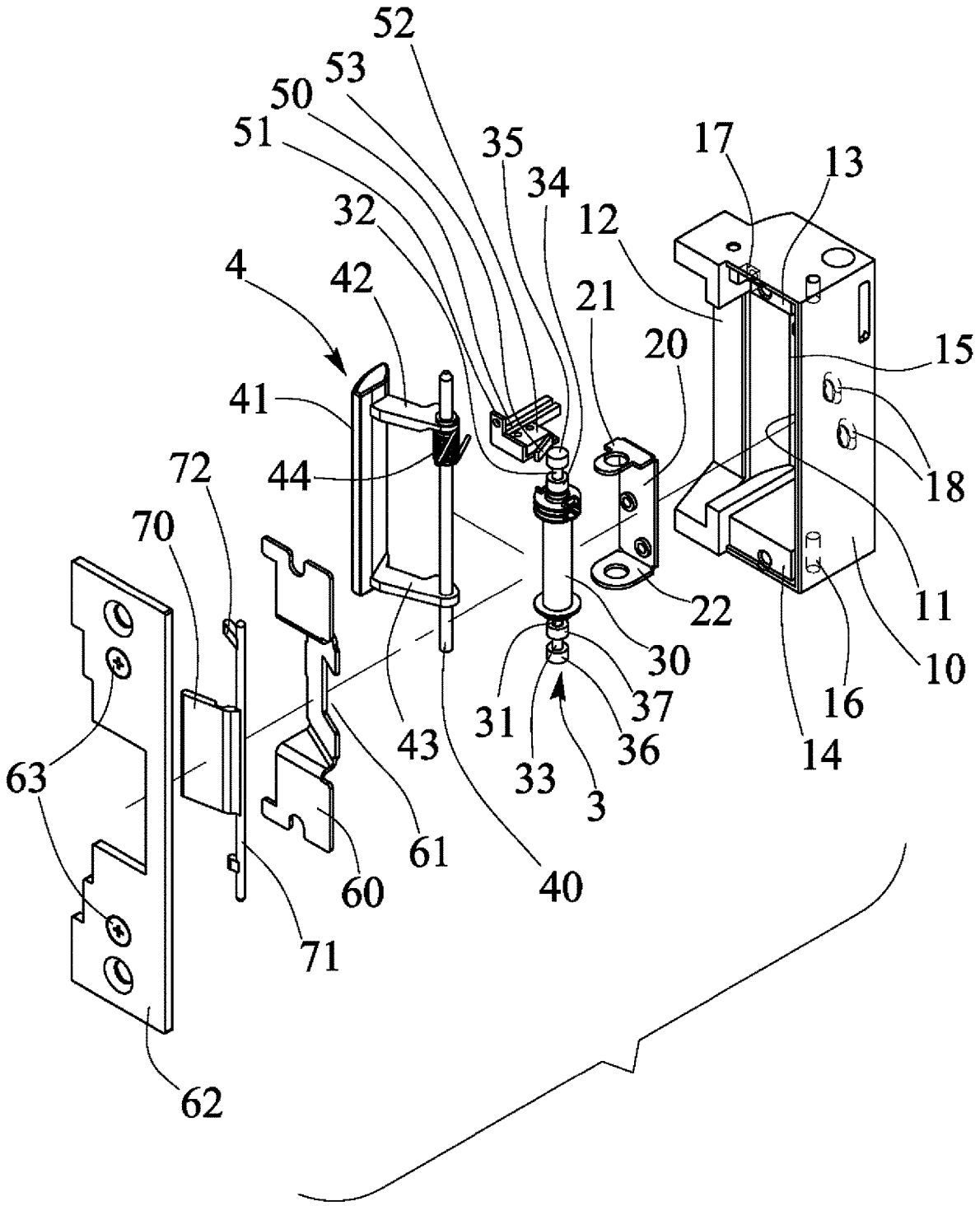
FIG. 4 is a partial exploded view of the door lock device.
Figure 5:
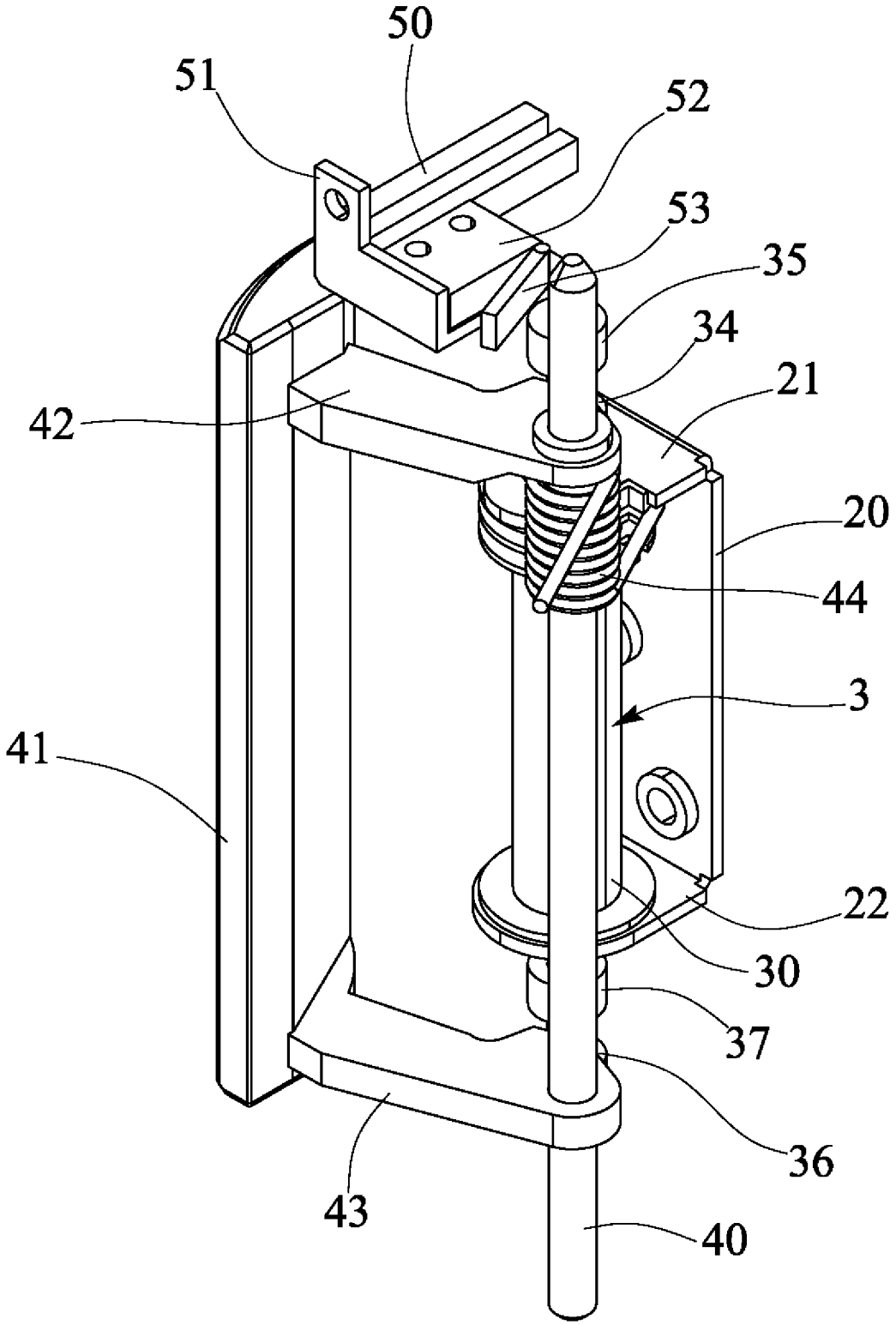
FIG. 5 is an enlarged partial perspective view of the door lock device.

Referring to the drawings, and initially to FIGS. 1 and 2, a door lock device 1 in accordance with the present invention is developed and provided for locking and unlocking a door device 9 which includes a door member or door frame or door panel 90 and a door element or door panel or door frame 91, and the door panel or door member 90 of the door device 9 is worked in cooperate with the door frame or door element 91 of the door device 9. The door lock device 1 is attached or mounted or secured to the door frame or door element 91 of the door device 9, and the door panel or door member 90 of the door device 9 includes a latch bolt 92 formed or provided or engaged therein for engaging with the door lock device 1 and for selectively anchoring or retaining or positioning or locking the door panel 90 to the door frame 91. A hand grip of knob 93 is also attached or mounted or secured to the door panel 90 and engaged with and connected or coupled to the latch bolt 92 for actuating or operating the latch bolt 92. The above-described structure or configuration for the latch bolt 92 and the knob 93 is typical and is not related to the present invention and will not be described in further details.

As shown in FIGS. 3-6, the door lock device 1 in accordance with the present invention comprises a container or housing 10 disposed or engaged into the door frame or door element 91 (FIG. 1), and including a chamber 11 formed therein (FIG. 4) for receiving various parts or members or elements or the like therein. The door lock device 1 or the housing 10 includes an entrance or notch 12 formed in one side portion thereof and communicating with the chamber 11 of the housing 10 for guiding the latch bolt 92 into the chamber 11 of the housing 10. The housing 10 includes an upper plate or panel 13, a lower or bottom plate or panel 14 and a rear plate or panel 15 for forming or defining the chamber 11 of the housing 10, and includes a hole or cavity 16 formed in each of the upper and the bottom panels 13, 14, and includes a recess or depression 17 formed in the upper panel 13, and includes one or more (such as two) apertures or screws or bolts or latches or fasteners 18 or the like attached or mounted or secured to or engaged with the rear panel 15 of the housing 10.

A frame or bracket 20 is disposed or engaged into the chamber 11 of the housing 10 and attached or mounted or secured to the rear panel 15 of the housing 10 with the fasteners 18 or the like, and includes one or more (such as two) ears or flaps 21, 22 extended therefrom for engaging with and for anchoring or retaining or supporting an actuator or solenoid device 3, i.e., the solenoid device 3 includes a cylinder or receptacle 30 attached or mounted or secured to the rear panel 15 of the housing 10 with the flaps 21, 22 of the bracket 20, and includes a core or sliding member or shaft 31 slidably received or engaged therein, and the shaft 31 includes one or first end portion 32 extendible upwardly out or beyond the receptacle 30 and the upper flap 21 of the bracket 20, and another or second end portion 33 extendible upwardly out or beyond the receptacle 30 and the lower flap 22 of the bracket 20, and includes one or more (such as two) stops or anchors 34, 35 formed or provided on the first end portion 32 of the shaft 31, and includes one or more (such as two) anchors or stops 36, 37 formed or provided on the second end portion 33 of the shaft 31.

A catch or latch device 4 includes an axle or spindle 40 engaged with the cavities 16 that are formed in the upper and the bottom panels 13, 14 of the housing 10 for allowing the latch device 4 to be pivotally or rotatably attached or mounted or secured to the housing 10 and received or engaged in the chamber 11 of the housing 10, and includes a stop or anchor or catch member 41 attached or mounted or secured to the spindle 40 with one or more (such as two) arms 42, 43, or the upper or first arm 42 and the lower or second arm 43 are connected or coupled between the catch member 41 and the spindle 40, for forming a substantially square or parallelepiped structure or configuration, and includes a spring biasing member 44 disposed or engaged onto the spindle 40, and/or engaged between the housing 10 and the latch device 4 for biasing and forcing or moving the catch member 41 into the chamber 11 of the housing 10 and for allowing the catch member 41 of the latch device 4 to be biased and forced and moved to engage with the latch bolt 92 (FIG. 2) selectively.

A seat or block 50 is engaged in the chamber 11 of the housing 10, and includes a peg or ear 51 extended therefrom and engaged in the depression 17 of the housing 10 and attached or mounted or secured to the housing 10 with such as latches or fasteners (not illustrated) or the like, and a detector or detecting device 52 is attached or mounted or secured to the block 50, and/or directly mounted or secured to the housing 10, and includes a switch knob or button 53 attached thereto or extended therefrom. A plate or partition 60 is disposed in front of the housing 10 and contacted or engaged with the upper and the bottom panels 13, 14 of the housing 10 and attached or mounted or secured to the housing 10 with such as latches or fasteners (not illustrated) or the like, and includes a notch or opening 61 formed therein and communicating with the chamber 11 of the housing 10 and aligned with the latch bolt 92 for allowing the latch bolt 92 to be engaged into the chamber 11 of the housing 10.

A tongue or detecting member or element 70 is pivotally or rotatably attached or mounted or secured to the housing 10 with a shaft or axle 71 and aligned with the opening 61 of the partition 60 for allowing the detecting member or element 70 to be moved or pivoted and engaged into the chamber 11 of the housing 10 with or by the latch bolt 92. An outer shield or cover plate 62 is disposed in front of the housing 10 and attached or mounted or secured to the upper and the bottom panels 13, 14 of the housing 10 with such as latches or fasteners 63, and the cover plate 62 and thus the housing 10 may be attached or mounted or secured to the door frame or door element 91 (FIG. 1) with such as latches or fasteners (not illustrated) or the like. The detecting element 70 includes an ear or peg or projection 72 extended from the axle 71 and arranged or located close to and/or beside the switch button 53 of the detecting device 52 for actuating or operating the detecting device 52 selectively when the detecting element 70 is depressed or actuated or operated by the latch bolt 92, and thus for sensing or detecting whether the latch bolt 92 of the door panel or door member 90 has been suitably engaged with the door lock device 1 or not (FIG. 2).

Figure 6:
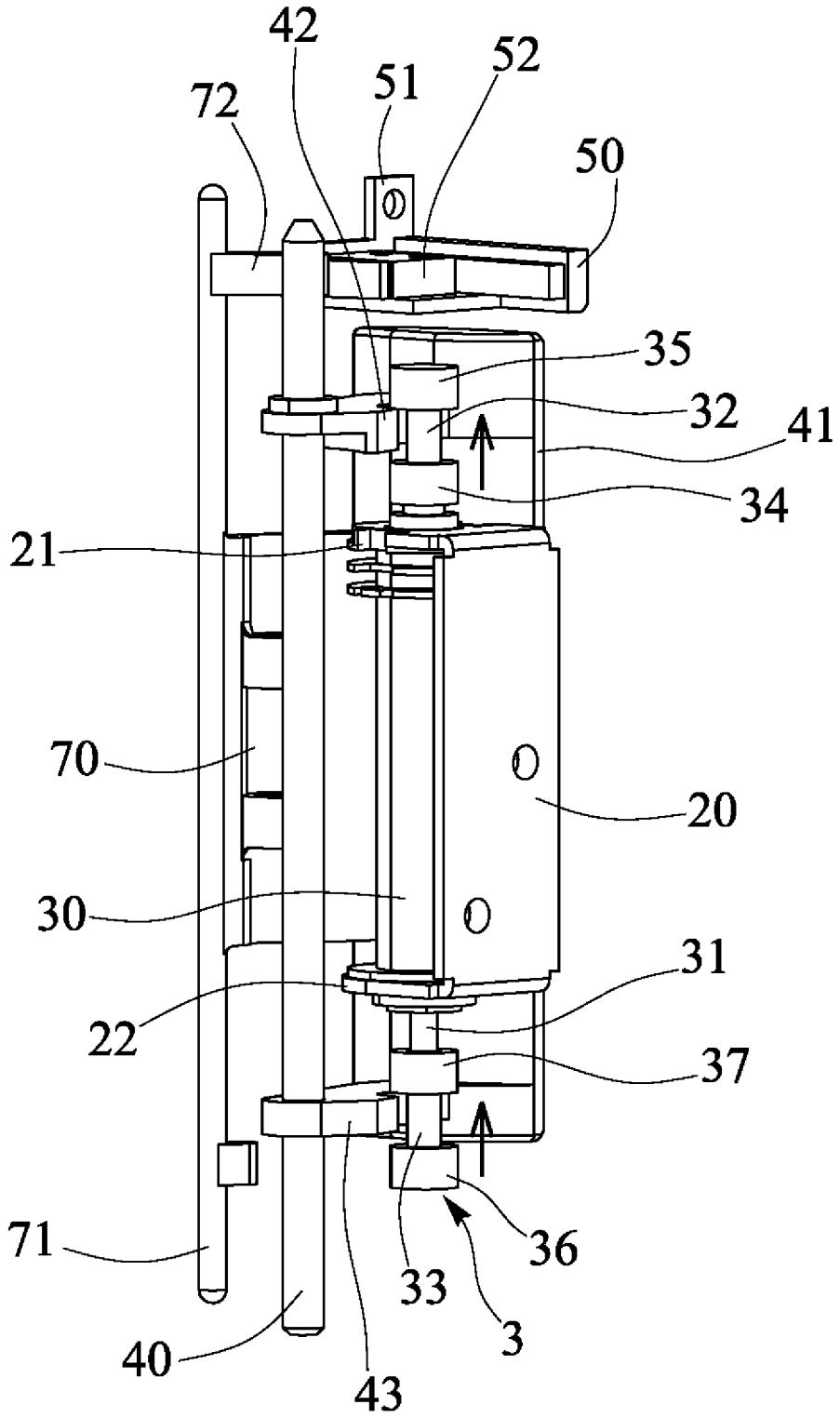
FIG. 6 is a further partial perspective view illustrating the operation of the door lock device.
Figure 7:
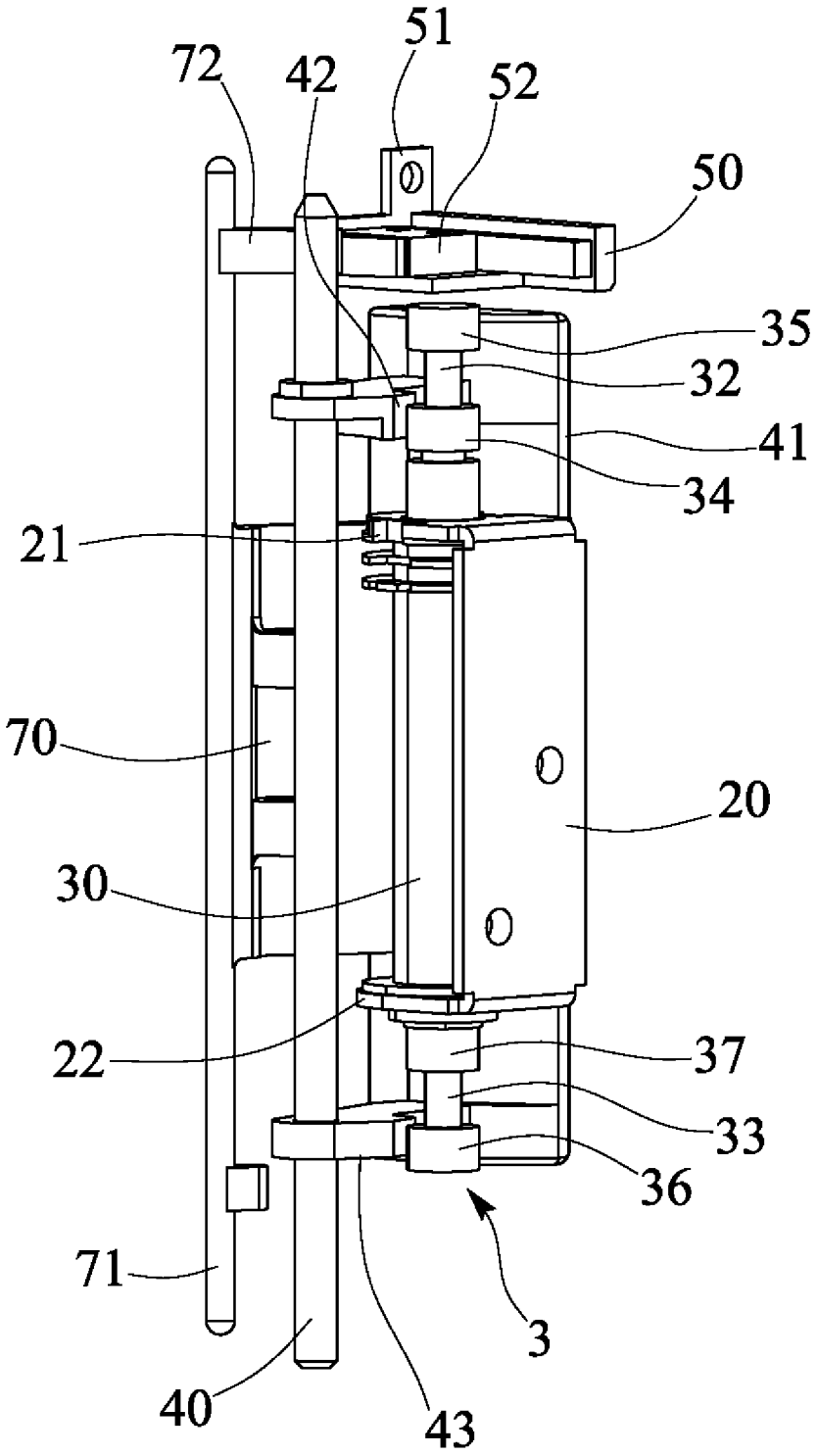
FIGS. 7, 8, 9 are further partial perspective views similar to FIG. 6, illustrating the operation of the door lock device.
Figure 8:
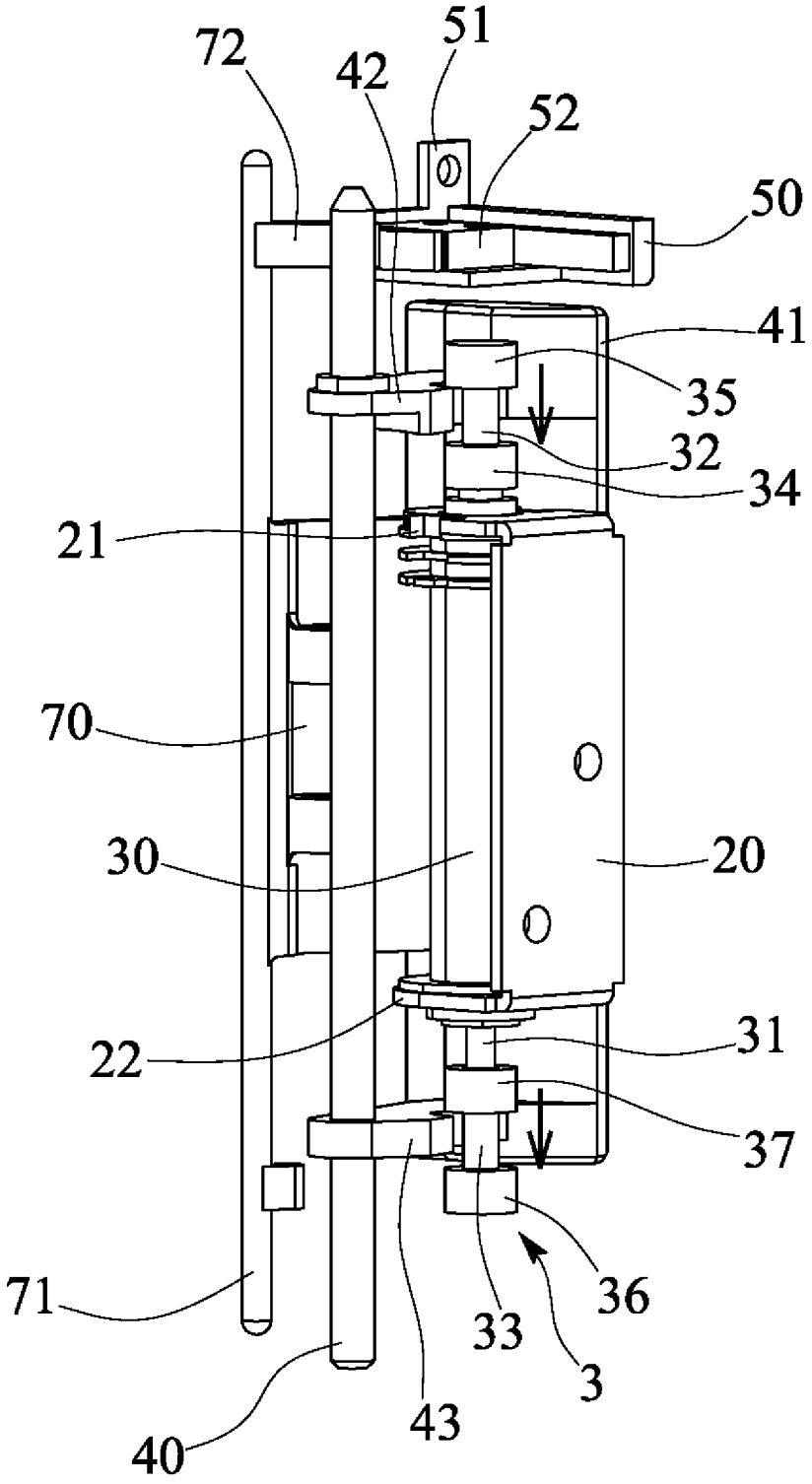
Figure 9:
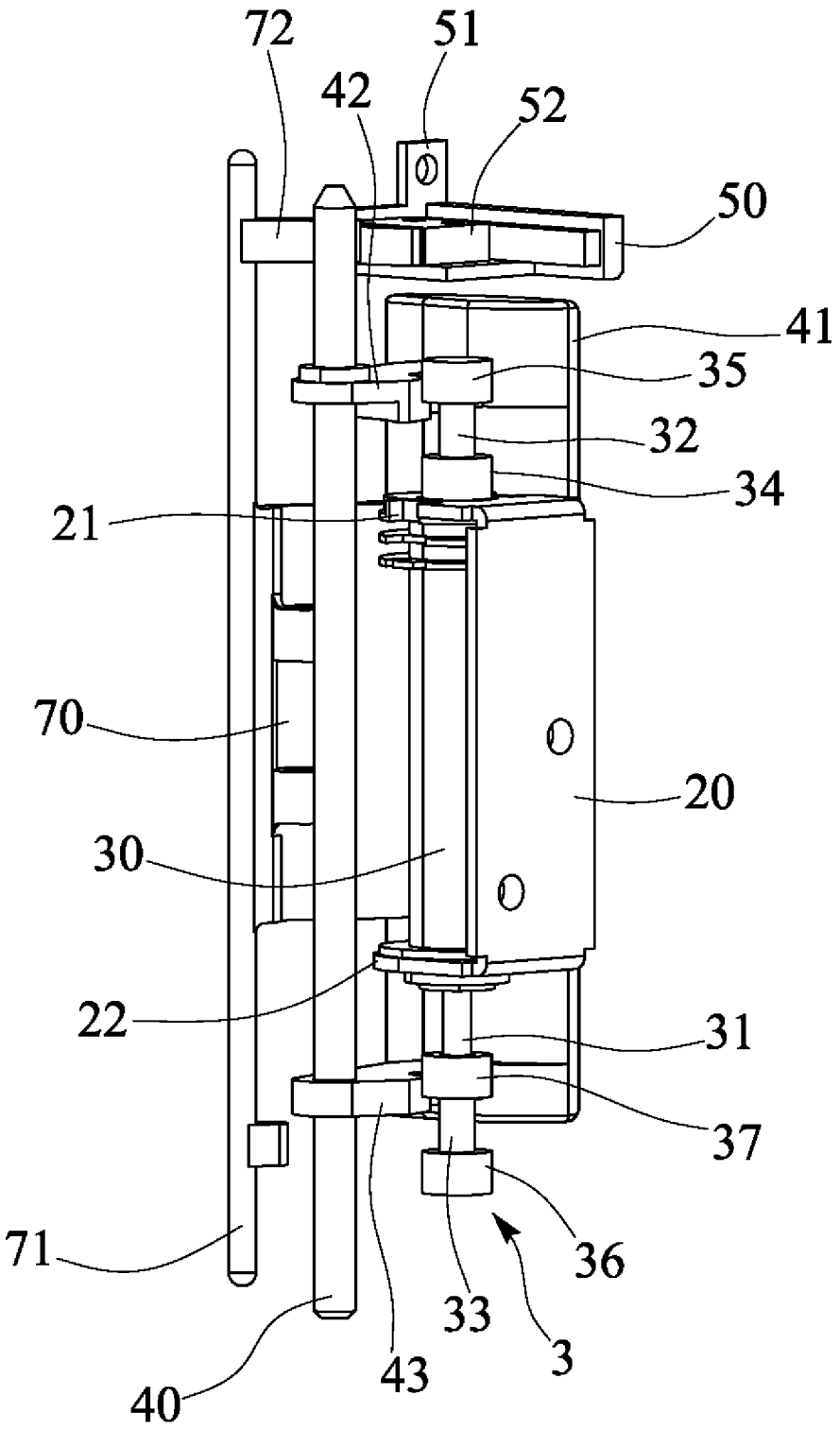

In operation, as shown in FIGS. 6-9, the core or shaft 31 of the solenoid device 3 may be actuated or operated or moved up and down relative to the receptacle 30 and the housing 10 by the solenoid device 3 when the solenoid device 3 is switched on or off, and as shown in FIGS. 6-7, when the shaft 31 of the solenoid device 3 is moved up relative to the receptacle 30 and the housing 10 by the solenoid device 3, one of the anchors 34 or the first anchor 34 and one of the stops 36 or the first stop 36 may be moved to be aligned with the arms 42, 43 of the latch device 4 and contacted or engaged with the arms 42, 43 respectively for allowing the catch member 41 and the arms 42, 43 of the latch device 4 to be evenly actuated or operated or depressed by the latch bolt 92. On the contrary, as shown in FIGS. 8 and 9, when the shaft 31 of the solenoid device 3 is moved down relative to the receptacle 30 and the housing 10 by the solenoid device 3, another or second anchor 35 and another or second stop 37 may be moved to be aligned with the arms 42, 43 of the latch device 4 and contacted or engaged with the arms 42, 43 respectively for allowing the catch member 41 and the arms 42, 43 of the latch device 4 to be evenly actuated or operated or depressed by the latch bolt 92.

As shown in FIGS. 6 and 8, when the solenoid device 3 is switched on or off, for example, when the solenoid device 3 is either switched off or energized to actuate or operate or move the shaft 31 relative to the receptacle 30 and the housing 10 until the anchors 34 and the stops 36 are not aligned with the arms 42, 43 of the latch device 4, the arms 42, 43 of the latch device 4 are not contacted or engaged with the anchors 34 and the stops 36, at this moment, the arms 42, 43 of the latch device 4 are freed and may be pivoted or rotated relative to the receptacle 30 and the housing 10 for allowing the latch bolt 92 to be released by the catch member 41 of the latch device 4.

It is to be noted that the catch member 41 of the latch device 4 may be tilted or inclined or bent relative to the housing 10 by the latch bolt 92 when only one of the arms 42, 43 of the latch device 4 is contacted or engaged with the anchors 34, 35 or the stops 36, 37; i.e., when only the upper or first arm 42 of the latch device 4 is contacted or engaged with one of the anchors 34, 35, or when only the lower or second arm 43 of the latch device 4 is contacted or engaged with one of the stops 36, 37, the catch member 41 of the latch device 4 may not be evenly actuated or operated or depressed by the latch bolt 92, and may be tilted or inclined or bent relative to the housing 10 by the latch bolt 92, such that the working life of the door lock device may be suitably increased and improved.

Accordingly, the door lock device in accordance with the present invention includes a safety structure or mechanism for allowing the door lock device to be suitably and safely operated or actuated and for allowing the working life of the door lock device to be suitably increased and improved.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door lock device comprising:

a door member;

a door element;

a latch bolt attached to said door element;

a housing attached to said door member, said housing including a chamber formed in said housing;

a solenoid device engaged in said chamber of said housing and attached to said housing;

a latch device including a catch member pivotally attached to said housing with a spindle for allowing said catch member to be pivoted and rotated relative to said housing, said latch device including a first arm connected between said catch member and said spindle and said latch device including a second arm connected between said catch member and said spindle; and said solenoid device including a receptacle, and a shaft slidably engaged in said receptacle and moveable either upwardly or downwardly relative to said receptacle, and said shaft including a first end portion extendible upwardly beyond said receptacle and a second end portion extendible downwardly beyond said receptacle, and said solenoid device including a first anchor and a second anchor provided on said first end portion of said shaft for selectively engaging with said first arm of said latch device, and a first stop and a second stop provided on said second end portion of said shaft for selectively engaging with said second arm of said latch device; and said first anchor or said second anchor being engaged with said first arm of said latch device when said shaft is moved upwardly and downwardly relative to said receptacle, and said first stop and said second stop being engaged with said second arm of said latch device when said shaft is moved upwardly and downwardly relative to said receptacle.

2. The door lock device as claimed in claim 1, wherein said latch device includes a spring biasing member engaged between said housing and said latch device for biasing and forcing said catch member to move into said chamber of said housing.

3. The door lock device as claimed in claim 2, wherein said spring biasing member is engaged onto said spindle.

4. The door lock device as claimed in claim 1, wherein said first arm and said second arm are connected between said catch member and said spindle for forming a parallelepiped structure.

5. The door lock device as claimed in claim 1, wherein said housing includes a bracket engaged in said chamber of said housing and secured to said housing for engaging with and for supporting said solenoid device in said housing.

6. The door lock device as claimed in claim 5, wherein said bracket includes two flaps extended from said bracket and engaged with said solenoid device.

7. The door lock device as claimed in claim 1, wherein said housing includes a partition attached to said housing, said partition includes an opening formed therein and communicating with said chamber of said housing and aligned with said latch bolt for allowing said latch bolt to be engaged into said chamber of said housing.

8. The door lock device as claimed in claim 1, wherein said housing includes a detecting device attached to said housing, and said detecting device includes a switch button, and a detecting element is pivotally attached to said housing with an axle, and said axle includes a projection extended from said axle and located close to said switch button of said detecting device for actuating and operating said switch button of said detecting device selectively when said detecting element is actuated by said latch bolt.

9. The door lock device as claimed in claim 8, wherein said housing includes a block engaged in the chamber of said housing and attached to said housing, said detecting device is attached to the block.

* * * * *